US005221131A

United States Patent [19]

Lesperance et al.

[11] Patent Number: 5,221,131

[45] Date of Patent: Jun. 22, 1993

[54] SHELVING ASSEMBLY

[75] Inventors: James L. Lesperance, Coleman; Howard G. Patz, Pound, both of Wis.

[73] Assignee: Patz Sales Corp., Pound, Wis.

[21] Appl. No.: 826,259

[22] Filed: Jan. 24, 1992

Related U.S. Application Data

[63] Continuation of Ser. No. 532,592, Jun. 4, 1990, abandoned.

[51] Int. Cl.[5] ..... A47B 48/00

[52] U.S. Cl. ..... 312/263; 312/265.3

[58] Field of Search ..... 312/108, 111, 257.1, 312/263, 265.3; 108/109, 111, 114; 52/470, 472

[56] References Cited

U.S. PATENT DOCUMENTS

| | | | |
|---|---|---|---|
| 1,806,610 | 5/1931 | Christensen | 312/263 |
| 2,424,217 | 7/1947 | Bales | 312/257.1 |
| 2,522,097 | 9/1930 | Cookson | 312/263 |
| 2,790,691 | 4/1957 | Goebel | 312/111 |
| 2,875,866 | 3/1959 | Hess | 52/470 |
| 3,044,632 | 7/1962 | Schild | 108/114 |
| 3,297,384 | 1/1967 | Buice | 312/263 |
| 3,376,679 | 4/1968 | Gregore | 52/472 |
| 4,296,983 | 10/1981 | Rogers et al. | 312/263 |
| 4,621,877 | 11/1986 | Boudreau | 312/263 |
| 4,664,040 | 5/1987 | Levenberg | 108/111 |

FOREIGN PATENT DOCUMENTS

| | | | |
|---|---|---|---|
| 0076073 | 12/1949 | Norway | 312/257.1 |
| 0645808 | 11/1950 | United Kingdom | 312/257.1 |

*Primary Examiner*—Gerald A. Anderson

*Attorney, Agent, or Firm*—Andrus, Sceales, Starke & Sawall

[57] ABSTRACT

A shelving unit includes one or more elongated back panels and a pair of elongated side panels all of which have longitudinal edges in the form of a rollback that provides flanges for interlocking with edges of other pieces. An elongated panel connector in the form of a channel having a pair of legs that extend angularly inwardly is utilized to connect the rollback edges of the back panels to form the back portion of the shelving unit.

10 Claims, 3 Drawing Sheets

FIG. 1
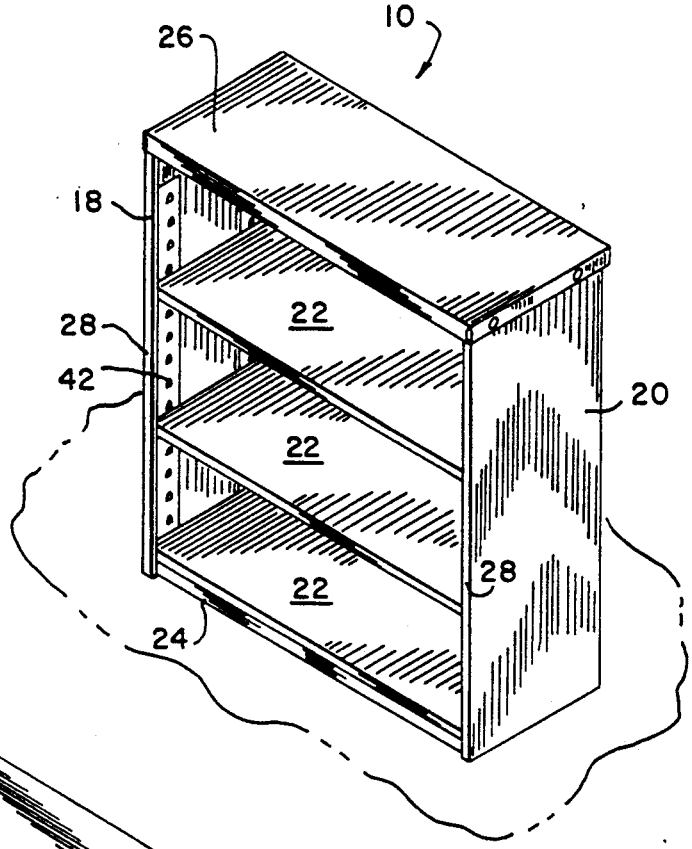
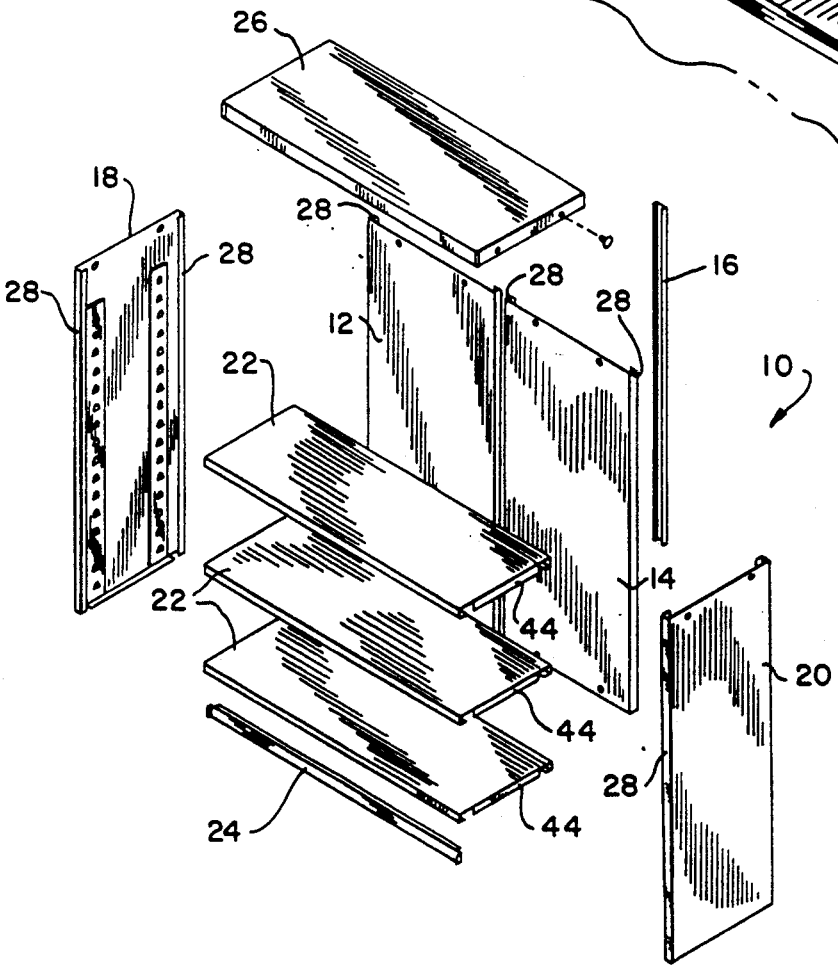
FIG. 2

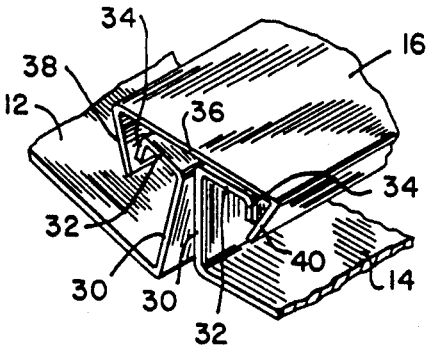
FIG. 4
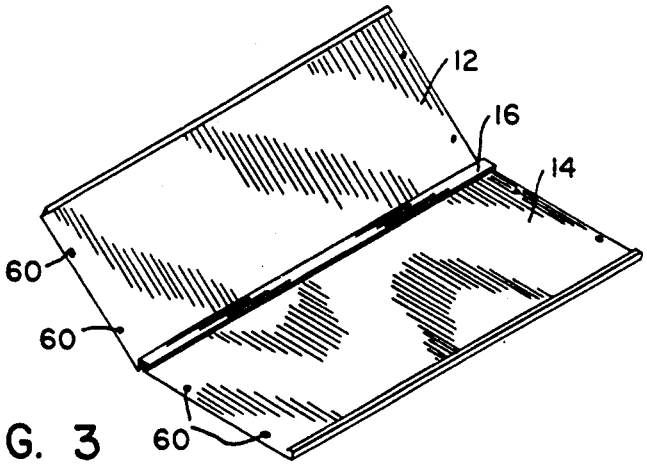
FIG. 3
FIG. 6
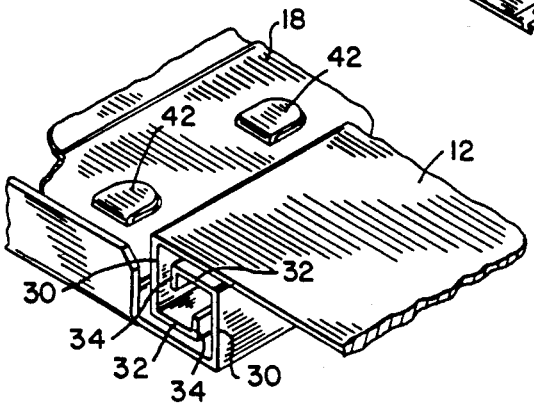
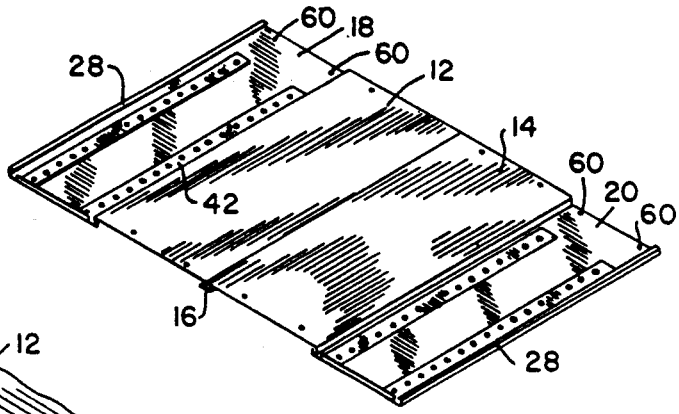
FIG. 5
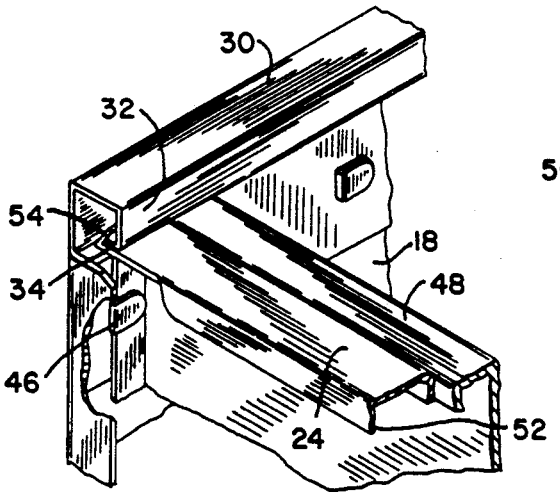
FIG. 7
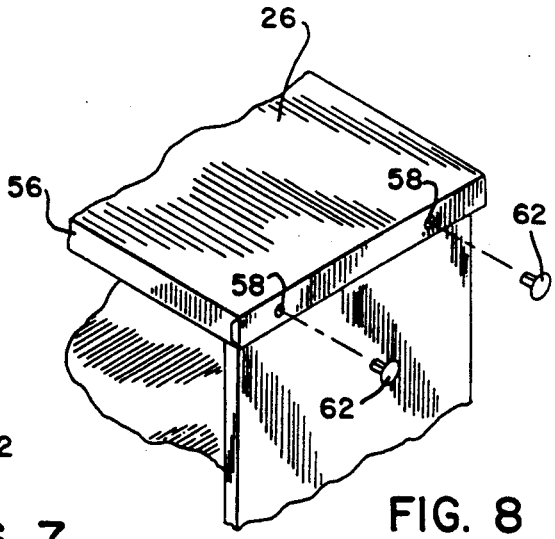
FIG. 8

SHELVING ASSEMBLY

This application is a continuation application Ser. No. 07/532,592, filed Jun. 4, 1990, now abandoned.

BACKGROUND OF THE INVENTION

The present invention relates to a shelving unit and more specifically to a shelving unit assembly that occupies a minimum amount of space in its unassembled state and which may be assembled without tools, bolts, nuts or screws.

The manufacturers of shelving units are faced with the following problems: (1) providing a shelving unit which in its unassembled state occupies a minimum amount of space so that it may be easily packaged, shipped and stored and (2) providing a shelving unit which may be assembled in a short amount of time with the utilization of a minimum number of tools. Prior art shelving units have met with limited success in solving these problems.

It is an object of the present invention to provide a shelving unit that may be easily packaged in a very compact shipping carton to be shipped and stored in its unassembled state and which may be assembled by the purchaser in a short period of time without the use of tools, bolts, nuts or screws.

SUMMARY OF THE INVENTION

A shelving unit assembly is provided with at least two elongated back panels whose longitudinal edges are in the form of a rollback that provides flange portions for interlocking with other similarly shaped edges.

In accordance with one aspect of the invention, an elongated panel connector is provided for joining the back panels. The panel connector is in the form of a channel whose legs extend angularly inwardly toward each other so that the opening of the channel is smaller than the base of the channel. With this configuration, an edge of a back panel may be placed in the channel and then rotated into a locking position within the channel.

In accordance with another aspect of the invention, the shelving unit is provided with a pair of elongated side panels each of which has a longitudinal edge which is also in the form of a rollback that provides flange portions for interlocking with the similarly shaped edges of the back panels.

In accordance with yet another aspect of the invention, the shelving unit is provided with a plurality of shelves that may be selectively placed and secured along the length of the side panels.

In accordance with still another aspect of the invention, the shelving unit is provided with an elongated base trim member that is disposed between the side panels at the bottom of the shelving unit.

In accordance with still another aspect of the invention, the shelving unit is provided with a planar top member having downwardly extending edges that overlap the top edges of the back panels and side panels.

The present invention thus provides a shelving unit that in its unassembled state requires a minimum amount of space for packaging, shipping, and storage. The present invention also provides a shelving unit that may be quickly assembled without the use of tools, bolts, nuts or screws.

BRIEF DESCRIPTION OF THE DRAWINGS

The drawings illustrate the best mode presently contemplated of carrying out the invention.

In the drawings:

FIG. 1 is a perspective view of a shelving unit constructed according to the present invention;

FIG. 2 is an exploded perspective view of the shelving unit of FIG. 1;

FIG. 3 is a perspective view of back panels and panel connector of the shelving unit in the process of being connected;

FIG. 4 is an enlarged perspective view of the back panels and panel connector in the process of being connected;

FIG. 5 is a perspective view of the back panels turned over from FIG. 3 and side panels laying flat;

FIG. 6 is an enlarged perspective view of the connection between the side panel and back panel;

FIG. 7 is a perspective view of the bottom of the shelving unit showing the connection between a side panel and a shelf and base trim piece;

FIG. 8 is a top perspective view of the top and side panel connection;

DETAILED DESCRIPTION OF THE PREFERRED EMBODIMENT

Figure 9:
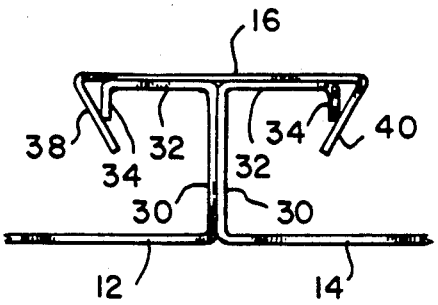
FIG. 9 is an end view of the back panels and panel connector in an assembled state.

As seen in FIGS. 1 and 2, a shelving unit 10 includes a pair of elongated back panels 12 and 14 joined by a panel connector 16. This connection will be explained in detail below.

Shelving unit 10 further includes a pair of elongated side panels 18 and 20 whose longitudinal edges mate with identical edges on back panels 12 and 14. This connection will also be explained in detail below.

Finally, shelving unit 10 is provided with a plurality of shelves 22, a base trim member 24 and a planar top member 26.

Shelving unit 10 can be assembled without tools, bolts, nuts or screws due to the fact that the longitudinal edges 28 of back panels 12 and 14 and side panels 18 and 20 are in the form of a rollback having an end portion 30 that extends outwardly from the panel at substantially a right angle. The rollback is further provided with an intermediate portion 32 that extends inwardly from the outer edge of end portion 30 and is substantially parallel to the panel.

Finally, the rollback is provided with a flange portion 34 that extends inwardly toward the panel from the end of intermediate portion 32 and at a substantially right angle to intermediate portion 32.

As mentioned above, the joining of back panels 12 and 14 is accomplished through the use of an elongated panel connector 16. Panel connector 16 is of a length substantially equal to that of back panels 12 and 14 and is in the form of a channel having a base 36 from which a pair of legs 38 and 40 extend inwardly towards each other so as to provide an opening to the channel that is smaller than base 36.

In order to connect back panels 12 and 14, they are placed with their longitudinal edges side by side and one of the back panels is rotated slightly as shown in FIGS. 3 and 4. Panel connector 16 may then be placed over the longitudinal edges of back panels 12 and 14.

The rotated back panel 12 is then lowered so that flange portions 34 of longitudinal edges 28 are disposed behind channel legs 38 and 40 and end portions 30 abut as shown in FIG. 9. This provides a secure and stable interlocking connection and allows for the formation of a large back assembly from a number of smaller pieces. While shelving unit 10 is shown utilizing a pair of back panels 12 and 14, it is possible to form an even wider shelving unit by utilizing more than two back panels and more than one panel connector 16. If it is desired to disassemble shelving unit 10, it is only necessary to rotate one of back panels 12 or 14 to an angle so that flange portion 34 is rotated out from behind a channel leg and then panel connector 16 may be lifted off longitudinal edges 28.

Figure 10:
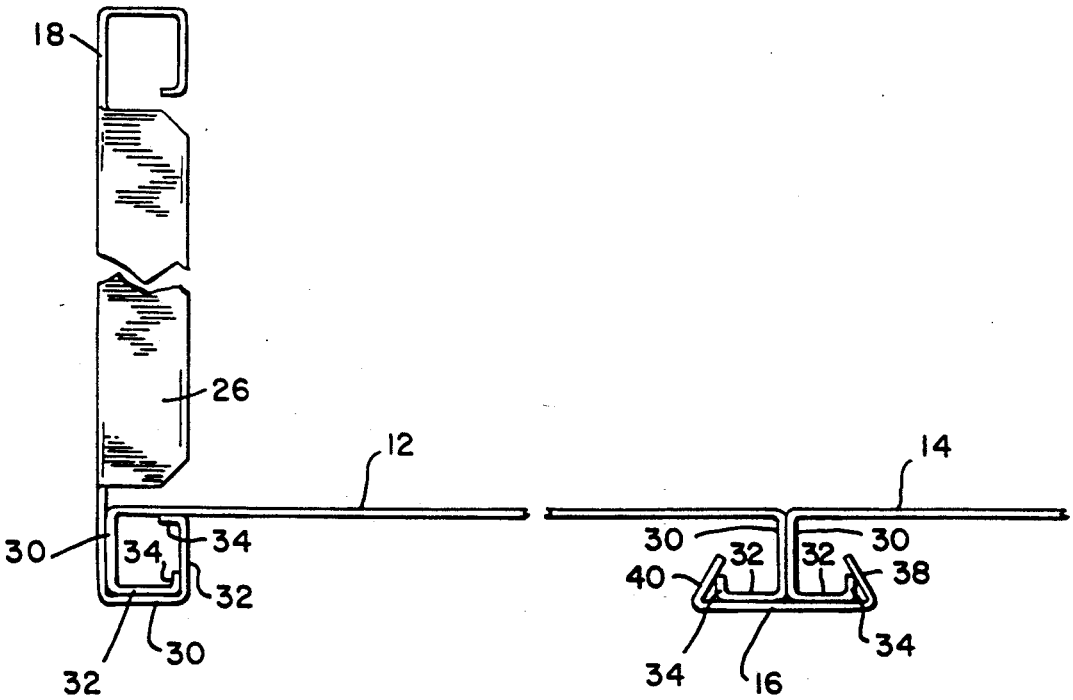
FIG. 10 is an end view of the side and back panels in an assembled state.

As seen in FIGS. 5 and 6, the connection of side panels 18 and 20 to back panels 12 and 14 is facilitated by the fact that each of side panels 18 and 20 is provided with an identical longitudinal edge having an end portion 30, an intermediate portion 32 and a flange portion 34 such as described above. To connect side panels 18 and 20 to back panels 12 and 14, side panels 18 and 20 are positioned along the outer longitudinal edges of back panels 12 and 14 so that the edge portions connect in the manner shown in FIG. 6. Side panels 18 and 20 are then rotated 90° so as to interlock the sides of shelving unit 10 as shown in FIG. 10. Intermediate portions 32 and flange portions 34 on the edges of the back and side panels provide the interlocking connection between these pieces.

Each of side panels 18 and 20 is provided with a series of tabs 42 that extend upwardly and are spaced from the inner surface of the side panel and each of shelves 22 is provided with a downwardly extending flange 44 at opposite ends of the shelf. Flanges 44 are inserted in the space between tabs 42 and the surface of the side panel. Since each of side panels 18 and 20 is provided with an array of tabs 42, the position of the shelves may be varied. However, one of the shelves must be positioned in the lowermost tabs 46 so as to provide a space for base trim 24 of shelving unit 10 as shown in FIG. 7.

Shelving unit 10 is also provided with an elongated base trim member 24 that is disposed immediately below bottom shelf 48. Trim member 24 includes an elongated channel member terminating at each end in a longitudinally extending V-shaped flange 54 that provides an interference fit with flange portion 34 on edge 28 of side panels 18 and 20.

As mentioned above, shelving unit 10 is provided with a planar top member 26 having downwardly extending flanges 56 around its perimeter. When planar top member 26 is installed, flanges 56 are disposed substantially adjacent to and overlap a portion of the top edges of back panels 12 and 14 and side panels 18 and 20. Also when installed, a pair of holes 58 on each end of top member 26 will align with a pair of holes 60 in the top of side panels 18 and 20. Nylon panel clips 62 are then manually inserted through the aligned openings to secure top member 26 to side panels 18 and 20.

The present invention thus provides a shelving unit assembly that in its unassembled state may be stacked and packaged in a rectangular box of reasonably small dimensions and which may be assembled without any tools, bolts, nuts or screws.

Various modes of carrying out the invention are contemplated as being within the scope of the following claims particularly pointing out and distinctly claiming the subject matter which is regarded as the invention.

We claim:

1. A shelving unit assembly comprising:

at least two elongated back panels, each of said back panels having a pair of longitudinal edges extending substantially the entire length of said back panel, with said edges in the form of a rollback that provides flange portions for interlocking with other edges, connecting means for joining said back panels, said connecting means comprising a channel shaped member having a base and a pair of legs with the legs of said channel shaped member extending angularly inwardly toward each other so that the opening to said channel is smaller than the base of said channel so that an edge portion of a back panel may be releasably disposed in said channel in a first portion and then rotated to a second position in which a flange portion of said edge is disposed behind a portion of a channel leg so as to prevent removal of said edge portion, said base of said channel shaped portion being dimensioned to accommodate a pair of said edges, a pair of elongated side panels, each of which has at least one longitudinal edge extending substantially the entire length of said side panel with said edge in the form of a rollback that provides flange portions for interlocking with a back panel rollback, said side panels having shelf retaining means whereby a plurality of shelves may be disposed between said side panels along their length, said side panel rollback and said back panel rollback being dimensioned so that said side panel and said back panel may be rotated relative to each other between a non-locking position which allows lateral separation of said side and back panels and an interlocking position in which lateral separation of said side and back panels is prohibited, and at least one elongated shelf disposed between said side panels.

2. The shelving unit assembly defined in claim 1 wherein said longitudinal edges of both said back and side panels comprise:

an end portion connected to and extending outwardly from said panel in a substantially perpendicular direction to said panel, an intermediate portion having one end connected to the outer end of said end portion and extending inwardly substantially parallel to said panel, and a flange portion connected to the other end of said intermediate portion and extending substantially perpendicularly from said intermediate portion toward said panel.

3. The shelving unit assembly defined in claim 1 wherein said connecting means comprises an elongated channel shaped panel connector extending substantially the entire length of said back panels.

4. The shelving unit assembly defined in claim 1 wherein each of said side panels includes a pair of longitudinal rollback edges disposed on opposite longitudinal edges of said side panel.

5. The shelving unit assembly defined in claim 1 further comprising a plurality of elongated shelves disposed between said side panels with one of said shelves comprising a bottom shelf disposed substantially adjacent the bottom of the shelving unit.

6. The shelving unit assembly defined in claim 5 further comprising an elongated base trim member connected to and disposed between said side panels, said trim member having an upper longitudinal edge disposed substantially adjacent a longitudinal edge of said bottom shelf.

7. The shelving unit assembly defined in claim 6 wherein said trim member comprises an elongated channel shaped member terminating at each end in longitudinally extending flange having a V-shaped outer edge providing an interference fit with said longitudinal edge of said side panel.

8. The shelving unit assembly defined in claim 1 wherein said shelf retaining means comprises a plurality of tabs disposed along said side panel, said tabs extending upwardly and spaced from said side panel, and said shelf having downwardly extending flanges at its opposite ends, said flanges being disposed in said space between said tabs and said side panels.

9. The shelving unit assembly defined in claim 1 further comprising a planar top member whose edges comprise downwardly extending flanges that are substantially adjacent to and overlap a portion of the top edges of said back and side panels.

10. A shelving unit assembly comprising:

at least two elongated back panels, each of said panels having a pair of longitudinal edges extending substantially the entire length of said back panel, with said edges in the form of a rollback that provides flange portions for interlocking with other edges, having an end portion connected to and extending outwardly from one of said panels in a substantially perpendicular direction to said panel, an intermediate portion having one end connected to the outer end of said end portion and extending inwardly substantially parallel to said panel and a flange portion connected to the other end of said intermediate portion and extending substantially perpendicularly from said intermediate portion toward said panel, connecting means for joining said back panels, said connecting means comprising an elongated channel shaped panel connector extending substantially the entire length of said back panels, and having a pair of legs extending angularly inwardly toward each other so that the opening to said channel is smaller than the base of said channel so that an edge portion of a back panel may be releasably disposed in said channel in a first position and then rotated to a second position in which a flange portion of said edge is disposed behind and frictionally engages a portion of a channel leg so as to prevent relative axial movement between said channel and said back panel and removal of said edge portion, said base of said channel shaped portion being dimensioned to accommodate a pair of said edges, a pair of elongated side panels, each of which has at least one longitudinal edge extending substantially the entire length of said side panel with said edge in the form of a rollback having an end portion connected to and extending outwardly from said panel in a substantially perpendicular direction to said panel, an intermediate portion having one end connected to the outer end of said end portion and extending inwardly substantially parallel to said panel, and a flange portion connected to the other end at said intermediate portion and extending substantially perpendicularly from said intermediate portion toward said panel, said side panels having shelf retaining means whereby a plurality of shelves may be disposed between said side panels along their length, and at least one elongated shelf disposed between said side panels.

* * * * *